US010406565B2

(12) United States Patent
Groten et al.

(10) Patent No.: US 10,406,565 B2
(45) **Date of Patent: *Sep. 10, 2019**

(54) CLEANING CLOTH

(71) Applicant: Carl Freudenberg KG, Weinheim (DE)

(72) Inventors: Robert Groten, Sundhoffen (FR); Andreas Eisenhut, Pullach (DE); Joerg Dunkel, Heidelberg (DE); Thorsten Gleich, Grasellenbach (DE)

(73) Assignee: CARL FREUDENBERG KG, Weinheim (DE)

( * ) Notice: Subject to any disclaimer, the term of this patent is extended or adjusted under 35 U.S.C. 154(b) by 138 days.

This patent is subject to a terminal disclaimer.

(21) Appl. No.: 15/119,132

(22) PCT Filed: Jan. 15, 2015

(86) PCT No.: PCT/EP2015/050660

§ 371 (c)(1),
(2) Date: Aug. 16, 2016

(87) PCT Pub. No.: WO2015/124335

PCT Pub. Date: Aug. 27, 2015

(65) Prior Publication Data

US 2017/0050220 A1 Feb. 23, 2017

(30) Foreign Application Priority Data

Feb. 21, 2014 (DE) ..... 10 2014 002 231

(51) Int. Cl.
*D04H 1/498* (2012.01)
*B08B 1/00* (2006.01)
(Continued)

(52) U.S. Cl.
CPC ..... *B08B 1/006* (2013.01); *D04H 1/498* (2013.01); *D04H 3/011* (2013.01); *D04H 3/016* (2013.01); *D04H 3/018* (2013.01)

(58) Field of Classification Search
CPC ..... D04H 1/498; D04H 3/011; D04H 3/016; D04H 3/018
See application file for complete search history.

(56) References Cited

U.S. PATENT DOCUMENTS 4,612,228 A 9/1986 Kato et al.
6,573,204 B1 6/2003 Philipp et al.
(Continued)

FOREIGN PATENT DOCUMENTS

CN 1283718 A 2/2001
CN 1402621 A 3/2003
(Continued)

*Primary Examiner* — Jeremy R Pierce
(74) *Attorney, Agent, or Firm* — Leydig, Voit & Mayer, Ltd.

(57) ABSTRACT

A cleaning cloth has a microfiber composite fleece material in which a first and a second fiber component are arranged in the form of alternating layers, wherein at least one first layer A has the first fiber component in the form of composite filaments which are melt-spun and deposited into a fleece and which are at least partially split into elementary filaments having an average titer of less than 0.1 dtex, preferably between 0.03 dtex and 0.06 dtex, and solidified, and wherein at least one layer B is arranged on the first layer A, wherein the layer B has the second fiber component in the form of fibers deposited into a fleece and solidified and having an average titer of 0.1 to 3 dtex, at least one second layer A is arranged on the layer B.

20 Claims, 6 Drawing Sheets

(51) Int. Cl.

| | |
|---|---|
| ***D04H 3/011*** | (2012.01) |
| ***D04H 3/016*** | (2012.01) |
| ***D04H 3/018*** | (2012.01) |

(56) References Cited

U.S. PATENT DOCUMENTS

| | | | | |
|---|---|---|---|---|
| 2001/0014393 | A1 | 8/2001 | Groten et al. | |
| 2006/0009106 | A1 | 1/2006 | Nishimura et al. | |
| 2006/0019570 | A1 | 1/2006 | Groten et al. | |
| 2006/0281383 | A1* | 12/2006 | Schmitt | D21F 1/0036 442/381 |
| 2007/0033779 | A1 | 2/2007 | Orlandi et al. | |
| 2009/0176063 | A1* | 7/2009 | Schubert | B32B 5/022 442/381 |
| 2010/0119794 | A1 | 5/2010 | Manstein et al. | |
| 2014/0317866 | A1* | 10/2014 | Burt | A47K 7/02 15/210.1 |
| 2015/0313439 | A1* | 11/2015 | Yabuzaki | D02G 3/04 134/6 |

FOREIGN PATENT DOCUMENTS

| | | | | |
|---|---|---|---|---|
| DE | 19903903 | A1 | 8/2000 | |
| DE | 10002778 | A1 | 8/2001 | |
| DE | 10044694 | A1 | 3/2002 | |
| EP | 1613802 | A2 | 1/2006 | |
| EP | 1619283 | A1 | 1/2006 | |
| EP | 1696064 | A1 | 8/2006 | |
| EP | 1696064 | A1 * | 8/2006 | B32B 5/022 |
| JP | S 58169557 | A | 10/1983 | |
| JP | H 03294558 | A | 12/1991 | |
| JP | H 11156980 | A | 6/1999 | |
| JP | 2005120504 | A | 5/2005 | |
| JP | 2006037334 | A | 2/2006 | |
| WO | WO 9208834 | A1 | 5/1992 | |
| WO | WO 9932288 | A1 | 7/1999 | |
| WO | WO 2004009347 | A1 | 1/2004 | |
| WO | WO 2006102360 | A2 | 9/2006 | |
| WO | WO 2008141687 | A2 | 11/2008 | |

* cited by examiner

Evolon specimen 7 new

Cross section

Scanning electron micrograph

CLEANING CLOTH

CROSS-REFERENCE TO RELATED APPLICATIONS

This application is a U.S. national stage application under 35 U.S.C. § 371 of International Application No. PCT/EP2015/050660, filed on Jan. 15, 2015, and claims benefit to German Patent Application No. DE 10 2014 002 231.5, filed on Feb. 21, 2014. The International Application was published in German on Aug. 27, 2015, as WO 2015/124335 A1 under PCT Article 21(2).

FIELD

The present application relates to cleaning cloths.

BACKGROUND

One way to combine various properties in one cleaning cloth consists in combining various types of fiber with each other for a given way to produce the fabric (as a woven or knitted fabric or as a nonwoven fabric, for example). Wovens or knits combining microfibers with thicker fibers thus exhibit good durability and also at least initially satisfactory performance characteristics. These fabrics, however, are disadvantageous in that they are more burdensome to produce than nonwoven fabrics. In addition, specifically fabrics produced by weft knitting with independently-movable needles are insufficiently retentive of microfibers. After about 400 industrial washing cycles (to DIN EN ISO 155797), nearly all the microfiber portions were found to have been removed. This is reflected in a distinct degradation of performance characteristics, such as handleability, skin sensorics, cleaning efficiency and/or water regimentation.

Nonwovens comprising microfibers are distinctly simpler to produce than wovens or knits. Nonwovens are structures formed from fibers finite in length (staple fibers), filaments (continuous-length fibers) or cut yarns of any type and origin that have been assembled into a web (a fiberweb) in some way and bonded together in some way. Microfiber nonwovens have in principle outstanding properties in the removal of soils and in pickup and release of liquids, particularly water. Existing microfiber nonwovens are disadvantageous, however, in that their durability, particularly to frequent washing in industrial washing cycles, is limited, as is reflected for example in holing occurring in the nonwovens after about 200 industrial washing cycles. When used in professional cleaning, with daily washing using disinfectant for example, these 200 washing cycles mean a service life of under a year.

In theory, raising the proportion of thicker fibers will improve nonwoven durability, since chemical and mechanical stability of single fibers/filaments increases with their thickness. However, this comes at the expense of performance characteristics.

Increasing the proportion of thin fibers leads as expected to improved performance characteristics, inter alia through improved water pickup due to the creation of a higher number of capillary interstices and through a softer hand due to reduced single fiber flexural stiffness. Sheet structures of this type, however, prove to be fragile when tear strength, pilling and particularly washability, especially washability at the boil, are compared with conventional textiles. Particularly performance characteristics ascribable to microfibers degrade significantly over time.

Namely, a PIE 16 nonwoven (70% PET 0.2 dtex, 30% PA6 0.1 dtex, split and hydroentangled) was found to suffer a distinct reduction in basis weight when subjected to a stress test of 400 washing cycles to DIN EN ISO 155797. Further analysis revealed that the polyamide fraction had declined from the original 30 down to 10 weight percent, whereas the PET fraction decreased less severely. This result was surprising in that bases, such as wash liquors, are known to attack PET, but not polyamide. A possible explanation for the result is that the comparatively fine polyamide filaments in the microfilament nonwoven are more likely to succumb to the chemical and mechanical stress in the wash and also to the high mechanical friction during tumble drying and to be transported away over time as broken fiber. This could also be due to the lower fiber thickness versus polyester.

The decrease in the proportion of PA6 after 500 washes in each case is illustrated in the table which follows. The residual polyamide content was determined by dissolving out with formic acid. It is the individual specimens which exhibit the variation in PA6 decrease.

TABLE 1

Reduction in PA6 portion after 500 washes (60° C.) from originally 30% to:

| No. | gross g | corr; −0.073 G | PET weighed g | corr; −0.071 g | gives PA6 g | PA6 content % |
|---|---|---|---|---|---|---|
| 1 | 1.475 | 1.402 | 1.26 | 1.189 | 0.213 | 15.19 |
| 2 | 0.673 | 0.6 | 0.593 | 0.522 | 0.078 | 13.00 |
| 3 | 0.97 | 0.897 | 0.855 | 0.784 | 0.113 | 12.60 |
| 4 | 1.567 | 1.494 | 1.36 | 1.289 | 0.205 | 13.72 |
| 5 | 1.605 | 1.532 | 1.442 | 1.371 | 0.161 | 10.51 |
| 6 | 1.301 | 1.228 | 1.173 | 1.102 | 0.126 | 10.26 |

These experiences suggest that the incorporation of twice as thick segments of PIE 8 for a given linear density of PIE 16 would improve the mechanical properties and robustness, and that the addition of half as thick segments coming from PIE 32, would lead to some restoration of sacrificed properties, such as moisture management and comfort.

A further way to combine downright contrary properties with one another in one sheetlike structure consists in forming a composite structure by combining two or more sheetlike structures. To this end, the individual sheetlike structures may be formed separately and then be combined with each other by means of known joining techniques, such as stitching, gluing, laminating.

Multicomponent spunbondeds having a linear density gradient are likewise known. EP 1 619 283 A1 describes multicomponent spunbondeds consisting of two or more polymers that form interfaces with each other and issue from one or more than one spinning apparatus having unitary spinneret die orifices and have been hydrodynamically attenuated, laid down in sheetlike form and—either as single plies or as multicomponent assembly—conjointly consolidated.

The problem addressed by the present invention is that of developing the known microfiber nonwovens further such that they offer good mechanical properties, in particular good sustained launderability coupled with good performance characteristics; good thermophysiological comfort; pleasant skin sensorics; pleasant appearance; good water management (absorption and water delivery, preferably at a uniform rate); and also good cleaning efficiency.

SUMMARY

An aspect of the invention provides a cleaning cloth, comprising: a microfiber composite nonwoven comprising a first fibrous component and a second fibrous component, arranged alternating plies, wherein at least one first ply A comprises the first fibrous component as melt-spun composite filaments laid down to form a web, at least some of which have been split into elemental filaments having an average linear density of less than 0.1 dtex, and consolidated, wherein at least one ply B is arranged on the first ply A, wherein the ply B comprises the second fibrous component as fibers having an average linear density of 0.1 to 3 dtex which have been laid down to form a web and consolidated, and wherein at least one second ply A is arranged on the ply B.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
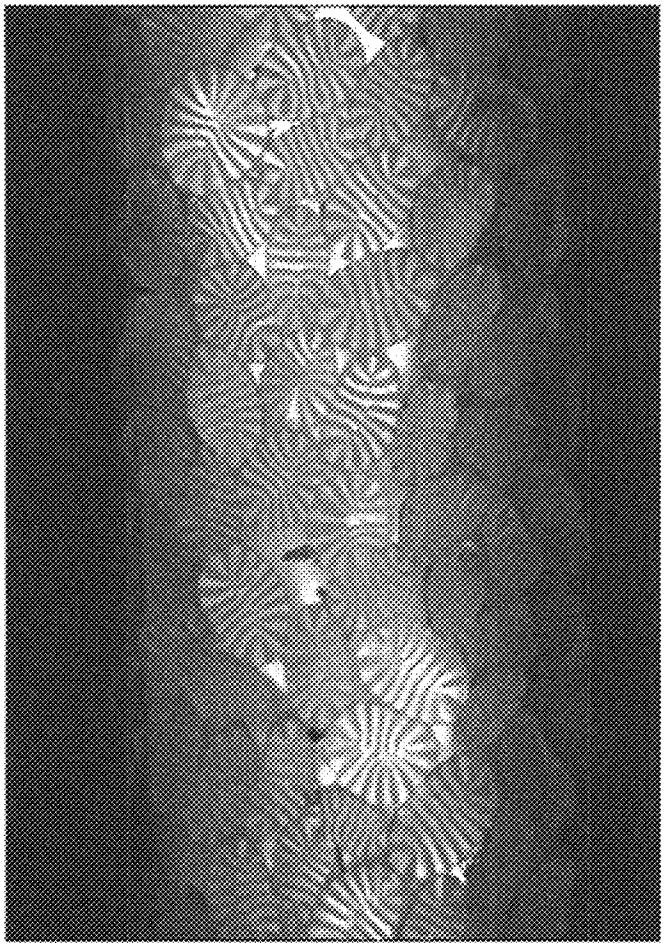
FIG. 1 shows a structure of a PIE 32 segmented bicomponent filaments.

Textile physical properties of cleaning cloths are controllable via the chemical and textile physical properties of their constituent fibers or filaments. In effect, the fibrous or filamentous raw materials are selected according to the chemical or physical properties desired, for example according to their dyeability, chemical resistance, thermoformability, soil pickup capacity or adsorption capacity. The modulus and stress-strain properties of fibers or filaments depend inter alia on the properties of their materials of construction, and the latter properties may be controlled via the cross-sectional geometry and the choice of the degree of crystallization and/or orientation in order to influence the flexural stiffness, the force absorption or the specific surface areas of the individual fibers or filaments. Basis weight is also used to control the sum total of the textile physical properties of the fibers or filaments making up a textile-type sheetlike structure.

There are many applications wherefore cleaning cloths have to meet a multiplicity of requirements that are often very difficult to bring into accord with one other. For instance, microfiber nonwovens are supposed to not only have a long service life but also offer good handleability, particularly during soaking, wringing out and wiping, good cleaning efficiency, good resistance to mechanical wear and/or a certain degree of water regimentation.

An aspect of the invention provides a cleaning cloth comprising a microfiber composite nonwoven in which a first and a second fibrous component are arranged in the form of alternating plies, wherein

- at least one first ply A comprises the first fibrous component in the form of melt-spun composite filaments laid down to form a web, some or all of which have been split into elemental filaments having an average linear density of less than 0.1 dtex, preferably between 0.03 dtex and 0.06 dtex, and consolidated,
- at least one ply B is arranged on the first ply A, wherein the ply B comprises the second fibrous component in the form of fibers having an average linear density of 0.1 to 3 dtex which have been laid down to form a web and consolidated,
- at least one second ply A is arranged on the ply B.

An aspect of the invention further provides a method of forming such a cleaning cloth and also the method of using the products obtained thereby.

The cleaning cloth of an aspect of the present invention comprises extremely fine microfilaments in synergistic combination with coarser fibers. At least a proportion of the two fibrous components is present therein in the form of plies which, in relation to the cross section of the microfiber composite nonwoven, form an alternating arrangement in at least regions thereof.

The inventors found that the specific combination of plies of fine and coarse fibers in an alternating arrangement improves the mechanical properties and the durability to a significant degree. The cleaning cloth of the present invention thus exhibits an outstanding level of sustained launderability, in particular in relation to the very stressful industrial hot washing cycles. In addition, notwithstanding the portion of coarser fibers, the nonwoven offers satisfactory performance characteristics such as good thermophysiological comfort, pleasant skin sensorics, a pleasant appearance, good water management, and also good cleaning efficiency.

This result is surprising in that the expectation had to be that while the use of filaments having a smaller filament linear density leads to improved performance characteristics, it also causes the resistance including in particular also the durability of the nonwoven to degrade.

Without wishing to be tied to any one mechanism, it is believed that the good mechanical strength with respect to pilling, abrasion and launderability of the nonwoven according to the present invention comes about due to the high degree to which the fine filaments become intertwined in the course of their production, i.e., in the course of splitting and/or the consolidation process, for example in the course of needling and/or water jet consolidating the composite elements.

In a preferred embodiment of the invention, the filaments of the first fibrous component—reaching as it were across ply boundaries—are at least partially intertwined with the fibers of the second fibrous component ("tentacle effect"). This effect is attainable, for example, by first forming a ply assembly ABA or else larger ply assemblies, for example a ply assembly ABABA, from initially still unconsolidated or merely preconsolidated webs of the first and second fibrous components and then performing a splitting and/or consolidating step for the entire ply assembly.

In this procedure, the fine filaments obtained on splitting the first fibrous component become distributed in the Z-direction, i.e., the direction of the nonwoven cross section. This distribution may comprise two or more plies and leads to a particularly intensive interbonding of the individual plies. Practical tests have shown that the degree to which the elemental filaments are transported into the other plies increases with their fineness.

According to the invention, the first fibrous component includes melt-spun composite filaments laid down to form a web. The term filaments is herein to be understood as meaning fibers which, in contradistinction to staple fibers, have a theoretically infinite length. Composite filaments consist of two or more elemental filaments, and may be split into elemental filaments, and consolidated, using customary methods of splitting, for example water jet needling. The composite filaments of the first fibrous component in the present invention are at least partly split into elemental filaments. The degree of splitting here is advantageously more than 80%, more preferably more than 90% and most preferably 100%.

To achieve an adequate stabilizing effect, the proportion of the elemental filaments of the first fibrous component is advantageously not less than 20 wt %, based on the overall weight of the nonwoven and as cumulative value across all composite plies. Practical tests have shown that a particularly high washfastness combined with good performance characteristics is obtainable when the proportion of these elemental filaments ranges from 20 wt % to 60 wt %, in particular from 30 wt % to 50 wt %, based on the overall weight of the nonwoven.

Regarding the individual plies of the nonwoven, advantageously the proportion of the elemental filaments of the first fibrous component in the particular ply A, for example in an outer ply A or in an inner ply A ranges from 80 wt % to 100 wt %, preferably from 90 wt % to 100 wt %, and more particularly is 100 wt %, all based on the overall weight of the ply A.

With an eye to the sustained use characteristics (pilling, abrasion and launderability), advantageously at least one outer ply but advantageously both the outer plies of the nonwoven are formed by the plies A.

In principle, the particular plies A may in addition to the first fibrous component conceivably comprise still further fibers. However, particularly good performance characteristics are obtained when at least the outer plies A consist wholly of elemental filaments of the first fibrous component.

The use of composite filaments as starting material for producing the elemental filaments is advantageous in that the linear density of the elemental filaments produced therefrom is simple to establish by varying the number of elemental filaments present in the composite filaments. The linear density of the composite filaments can remain constant here, which is a technical advantage. The use of composite filaments is further advantageous in that varying the degree of splitting of the composite filaments additionally provides a simple way to control the ratio of thicker and thinner filaments in the nonwoven.

Practical tests have shown that nonwovens having a particularly high washfastness in combination with good performance characteristics are obtainable when the average linear density of the elemental filaments of the first fibrous component is between 0.01-0.1 dtex, in particular in the range from 0.03 dtex to 0.06 dtex. Elemental filaments having this linear density are obtainable, for example, by splitting composite filaments having a linear density of 0.02 to 6.4 dtex, preferably of 0.06 to 3.8 dtex.

The cross section of these elemental filaments may be circular arc segment shaped, n-angular or multilobal.

The microfiber composite nonwoven of the present invention is preferably one wherein the composite filaments have a cross section of orange wedge or pie multisegmented structure wherein the segments may contain various, alternating, incompatible polymers. Likewise suitable are hollow pie structures which may also have an asymmetric axial cavity. Pie structures, in particular hollow pie structures, split particularly easily.

With regard to the first fibrous component, the orange wedge and/or pie (pie slice, to be more precise) arrangement advantageously includes 2, 4, 8, 16, 24, 32 or 64 segments, more preferably 16, 24 or 32 segments.

The proportion of the first fibrous component in the nonwoven is preferably not less than 40 wt %, more preferably in the range from 40 wt % to 60 wt %, most preferably in the range from 45 wt % to 55 wt %, all based on the overall weight of the nonwoven.

To obtain easy splittability, it is advantageous for the composite filaments to comprise filaments comprising two or more thermoplastic polymers. The composite filaments preferably comprise two or more incompatible polymers. Incompatible polymers are polymers which combine to produce pairings that are not, or only marginally/poorly adherent. A composite filament of this type is readily splittable into elemental filaments and gives rise to a favorable ratio of strength to basis weight.

By way of incompatible polymer pairs, it is preferable to employ polyolefins, polyesters, polyamides and/or polyurethanes in a combination such that they produce pairings that are not, or only marginally/poorly adherent.

The polymer pairs used are more preferably selected from polymer pairs featuring at least one polyolefin, and/or at least one polyamide, preferably featuring polyethylene, such as polypropylene/polyethylene, nylon-6/polyethylene or polyethylene terephthalate/polyethylene, or featuring polypropylene, such as polypropylene/polyethylene, nylon-6/polypropylene or polyethylene terephthalate/polypropylene.

Polymer pairs featuring at least one polyester and/or at least one polyamide are very particularly preferred.

Polymer pairs featuring at least a polyamide or featuring at least a polyethylene terephthalate are preferred on account of their limited adherability and polymer pairs featuring at least a polyolefin are used with particular preference on account of their poor adherability.

As particularly preferred components, polyesters, preferably polyethylene terephthalate, polylactic acid and/or polybutylene terephthalate on the one hand, polyamide, preferably nylon-6, nylon-6,6, nylon-4,6, on the other, optionally in combination with one or more further polymers incompatible with the abovementioned components, preferably selected from polyolefins, have been found to be particularly advantageous. This combination exhibits outstanding splittability. Very particular preference is given to the combination of polyethylene terephthalate and nylon-6 or of polyethylene terephthalate and nylon-6,6.

The proportion of the second fibrous component in the nonwoven is preferably not less than 30 wt %, preferably in the range from 40 wt % to 60 wt %, in particular from 45 wt % to 55 wt %, all based on the overall weight of the nonwoven.

The particular plies B, in addition to the second fibrous component, may conceivably comprise still further fibers. Advantageously in fact, the particular plies B comprise fibers of the first fibrous component as well as the second fibrous component. These fibers of the first fibrous component may have been imported from the plies A into the ply B, for example in the course of consolidation and/or splitting. This provides a higher degree of intertwining between the plies and hence a higher level of strength.

The nature of the fibers of the second fibrous component is in principle immaterial provided they have a linear density of 0.1 to 3 dtex. The fibers of the second fibrous component may thus be selected from the group consisting of filaments, staple fibers, threads and/or yarns. Staple fibers, in contradistinction to filaments, which have a theoretically infinite length, are fibers having a finite length, preferably in the range from 20 mm to 60 mm.

The fibers of the second fibrous component may consist of a very wide variety of materials. Especially polymers, and of these particularly plastics, especially the plastics already discussed above in relation to the first fibrous component, but also natural materials are suitable. The selection of the fibers of the second fibrous component is advantageously made according to the particular sectors in which the nonwoven is to be employed. Filaments have been found to be suitable for many applications. Filaments may be present as monocomponent filaments and/or composite filaments.

Preferably, the fibers of the second fibrous component, like the filaments of the first fibrous component, are at least partly present as composite filaments and are at least partly split into elemental filaments. In this case, at least a portion of these elemental filaments have a linear density of 0.1 to 3 dtex. It is very particularly preferable for all these elemental filaments to have this linear density. Elemental filaments of this type are obtainable by splitting of composite filaments having a linear density of 0.2 to 24 dtex.

The use of composite filaments is also advantageous here in that the linear density of the individual elemental filaments is simple to establish by varying the number of elemental filaments present in the composite filaments. In addition, varying the degree of splitting provides a way to control the ratio of thicker and thinner filaments in the nonwoven. Practical tests have shown that particularly good pilling properties are obtainable by establishing the degree of splitting of the composite filaments at not less than 60%, more preferably at not less than 70%, more preferably at 80% to 100%.

A further advantage is that, in this embodiment, a consolidation of the nonwoven may preferably be effected by conjoint splitting of the two composite filament components, for example by water jet consolidation. The elemental filaments formed in the splitting operation intertwine in this procedure particularly intensively, across the layer boundaries, and therefore the composite nonwoven obtained is particularly robust.

Composite filament type and structure may correspond to that discussed above for the first fibrous component. The composite filaments of the second fibrous component consist with preference of 2, 4, 8, 16 elemental filaments and with particular preference of 4 or 8 elemental filaments. Alternatively, the fibers of the second fibrous component may be monocomponent filaments and/or a mixture of composite filaments with monocomponent filaments.

It is preferable for the purposes of the present invention when the average linear density of the filaments of the first fibrous component is distinctly below the average linear density of the fibers of the second fibrous component. However, practical tests have shown that to establish high strength and good performance characteristics, the fibers of the second fibrous component advantageously have an average linear density of not more than 30 times, preferably not more than ten times the average linear density for the filaments of the first fibrous component.

It has been found to be particularly advantageous for the ratio of the average filament linear density of the filaments of the second fibrous component to the average filament linear density of the filaments of the first fibrous component to be in the range from 6 to 16, preferably in the range from 8 to 12. Nonwovens having such a ratio have transpired to be particularly resistant to delamination.

As already noted above, the alternating arrangement of plies of fibers having large and small fiber linear densities is an essential characteristic of the nonwoven according to the present invention. In a particularly preferred arrangement, the fiberplies of high linear density are at least partly interpenetrated by filaments from the fiberplies of low linear density ("tentacle effect"). This makes it possible to gain maximum protection of the coarse filaments on the inside, which have a lower degree of intertwining with each other and hence a low stability, from fine filaments on the outside, which have a high degree of intertwining with themselves and with the coarse filaments and so have good stability. At the same time, the fine filaments on the outside, which are of inherently lower mechanical strength and stiffness and so have a higher tendency to pill (fibers are simpler to detach out of the assemblage through mechanical stress), become better anchored in the overall assemblage making up the nonwoven. This may more particularly be effected through the abovementioned "tentacle effect", which serves to bind them better into the adjacent plies comprising filaments of higher linear density.

Against this background, it is advantageous for at least a portion of the surface of the nonwoven to be formed by the elemental filaments having a linear density of less than 0.1 dtex. It is accordingly advantageous for at least one of the surfaces, preferably both of the surfaces, of the nonwoven to be at least 50%, preferably 60-100% formed by the elemental filaments having a linear density of less than 0.1 dtex. Surface texture and composition is ascertainable using scanning electron micrographs for example.

Providing the fine filaments on the nonwoven exterior has the advantage that interior threads of filaments of any kind, but particularly the coarse fibers of the second fibrous component become mechanically stabilized. At the same time, the surface of the nonwoven has advantageous performance characteristics and also an advantageous appearance and hand.

To form the alternating arrangement of coarse and fine fibers in the composite nonwoven of the present invention, for example, plies comprising filaments of the first fibrous component and plies comprising filaments of the second fibrous component may be separately formed and combined with each other in the desired arrangement. The plies may be combined using known methods of joining, such as stitching, gluing, laminating and/or mechanical needling, in which case the individual plies are optionally consolidated in the process. A particularly simple way to combine the plies is as part of a step wherein the composite filaments in the nonwoven are subjected to hydroentangling. It is also possible here for the plies to be separately preconsolidated before being combined.

The fibers of not only the first but also of the second fibrous component are preferably composite filaments at least partially split into elemental filaments. In this case, the nonwoven is preferably consolidated by conjointly splitting the two composite filament components. This can be effected for example by first forming a ply assembly from webs of the first and second fibrous components and then effecting a consolidation, for example using water jets. The elemental filaments formed in the splitting operation intertwine in this procedure particularly intensively, across the layer boundaries, and therefore the composite nonwoven obtained is particularly robust.

To obtain a high degree of intertwining, the degree of splitting, in particular of the first fibrous component, is advantageously as high as possible. Against this background, the proportion of the respective elemental filaments of the first or second fibrous component in the plies is advantageously more than 80 wt %, more preferably 85 to 100 wt %.

In a particularly preferred embodiment of the invention, all plies A comprise at least partially split pie 24 filaments, pie 32 filaments and/or pie 64 filaments. It is further conceivable for all the plies B to comprise at least partially split pie 8 filaments or pie 4 filaments. It is likewise conceivable to have an arrangement wherein one or more plies B comprise pie 8 filaments and other plies B comprise pie 16 filaments and/or pie 4 filaments.

As already noted above, it has been found to be particularly beneficial to arrange the plies such that the plies B, comprising the fibers of the second fibrous component, are in the interior of the nonwoven while the plies A, comprising the filaments of the first fibrous component, are disposed on the nonwoven surfaces at least. In this arrangement, the outer plies comprising fine filaments are surprisingly capable—notwithstanding their fine linear density and their mechanical sensitivity resulting therefrom—of offering effective protection to the inner plies which, as noted above, leads to the formation of a particularly stable assemblage of layers and good sustained use characteristics.

This effect is possibly attributable to the fine filaments obtained on splitting becoming distributed in the Z-direction, i.e., in the direction of the cross section of the nonwoven, in the course of the consolidating step. This distribution may comprise two or more plies and leads to a particularly intensive interbonding of the individual plies. Practical tests have shown that the degree to which the elemental filaments are transported into the adjoining plies increases with their fineness.

The nonwoven of the present invention comprises two or more plies A, comprising filaments of the first fibrous component, and also one or more than one ply B, comprising filaments of the second fibrous component. This results in the alternating base ply sequence of A-B-A. As already noted above, the binding of ply B into the interior of the layered assemblage provides a composite nonwoven having excellent long-term stability. And the nonwoven has very good performance characteristics as a result of the outer sides of the nonwoven being formed by plies A.

The ABA base ply sequence of the present invention may be expanded to include further alternating plies A and B. A further preferred embodiment of the invention thus comprises the ply sequences: $A(BA)_nBA$ where n=1 to 20, preferably n=5 to 15 and particularly from 8 to 12. Examples of ply sequences are thus ABABABA, ABABABABA, etc. In this connection, it is conceivable for one or more plies A to comprise two or more sub-plies A' and/or one or more plies B to comprise two or more sub-plies B'. The fibers in the respective sub-plies may have the same linear density or a different one. A spinning plant featuring 15 spinning positions could thus conceivably have for example the following arrangement of sub-plies A' and B':

A'A'B'B'B'A'B'B'B'A'B'B'B'A'A', which to a later observer of the cross section results in $A(BA)_2BA$.

In a preferred embodiment of the invention, the outer plies in the ply sequences are in each case formed by the plies A. The ply sequences are further advantageously notable for an alternating arrangement of the plies A and B. As explained above, however, it is likewise conceivable for the ply sequence to include further plies, plies other than A and B.

It has likewise been found to be advantageous to engineer the ply sequence of plies A and B and also of any further plies present in the microfiber composite nonwoven so as to obtain a symmetrical layered construction. This arrangement has the advantage of providing a particularly uniform, side-symmetrical profile of properties.

In a preferred embodiment of the invention, all the plies A and/or B each include fibers having the same fiber linear density. These embodiments are advantageous because they provide a particularly simple way to form the nonwoven. In an alternative preferred embodiment, however, various plies A (and/or B) and/or sub-plies A' (and/or B') include fibers having different fiber linear densities. The advantage in this case is that the properties of the nonwoven can be established in a very precise and side-specific manner.

The composite nonwoven of the present invention may also contain further plies. It is conceivable in this regard that the further plies are configured as reinforcing plies, for example in the form of a scrim, and/or that they comprise non-crimp fabrics, knitted fabrics other than those produced by weft knitting with independently-movable needles, woven fabrics, nonwoven fabrics and/or reinforcing filaments. Plastics, for example polyesters, and/or metals are preferred materials to form the further plies. The further plies may conceivably in principle form the outer plies of the nonwoven. Advantageously, however, the further plies are (perhaps additionally) arranged in the interior of the nonwoven, between the plies A and B.

The polymers employed to form the filaments of the composite nonwoven may comprise one or more than additive selected from the group consisting of color pigments, antistats, antimicrobials such as copper, silver, gold, or hydrophilicizing or hydrophobicizing additives in an amount of 150 ppm to 10 wt %. Using the recited additives in the polymers employed permits conformation to customer-specific requirements.

Basis weights of the composite nonwoven according to the present invention are established according to the intended purpose of use. Basis weights found advantageous for many applications are measured to DIN EN 29073 and range from 10 to 500 g/m, preferably from 20 to 300 g/m$^2$ and especially from 30 to 250 g/m.

As explained above, the microfiber composite nonwoven of the present invention has outstanding mechanical properties. The microfiber composite nonwoven according to a preferred embodiment of the invention is accordingly characterized by substantial durability. It was determined for instance that exemplary nonwovens of the present invention are free from holes even after 850 industrial washing cycles to DIN EN ISO 155797.

The microfiber composite nonwoven is advantageously further characterized by a simple-to-establish tear strength to DIN EN ISO 155797.

The microfiber composite nonwoven of the present invention is further notable for a readily adjustable moisture regime.

The microfiber composite nonwoven of the present invention is obtainable in a manner known to a person skilled in the art. A method that was found to be particularly simple comprises at least one first fiberply comprising filaments of the first fibrous component and at least one second fiberply comprising filaments of the second fibrous component being formed and combined.

The method of forming the composite nonwoven of the present invention is advantageously carried out as follows:

First the individual fiberplies are separately spun, laid down to form a web and optionally, by needling for example, preconsolidated. The fiberplies are subsequently combined with each other.

Especially with regard to the plies B which, as set out above, are advantageously arranged in the interior of the composite nonwoven, a preconsolidating operation will be found advantageous because this can be used to prevent fibers of the second fibrous component passing to the surface of the composite nonwoven.

The combining of the individual plies may be brought about using known methods of joining, such as stitching, gluing, laminating, calendering and/or needling.

However, it is particularly preferable to combine the individual plies by plies comprising fibers of the first fibrous component and plies comprising fibers of the second fibrous component being, after their production, alternatingly arranged on top of each other and then directly consolidated and simultaneously combined with each other, for example by mechanical consolidation and/or hydrofluid treatment.

A hydrofluid treatment can be used to have the composite nonwoven consolidated from out to in, optionally split and intimately entangled with the coarser filaments on the inside. This procedure makes for a particularly efficacious use of the low filament linear density filaments because the fine filaments are transported very deeply into the nonwoven and there—evidently due to their intertwining-lead to a particularly effective stabilization of the composite ("tentacle effect").

Fiberply consolidation and splitting is advantageously effected by impinging the optionally preconsolidated nonwoven composite at least once on each side with high pressure fluid jets, preferably with high pressure water jets. The composite nonwoven of the present invention thereby acquires the appearance of a textile surface and the degree of splitting of the composite filaments may be established at more than 80%.

It is also conceivable for fibers of the first and second fibrous components to issue from a unitary spinning and/or laydown process, to be simultaneously produced and conjointly laid down. To this end, there may be two or more spinning stations each having unitary spinneret die orifices to produce the composite filaments with a differing number of elemental filaments or a mixture of composite filaments with monocomponent filaments in one conjoint spinning and drawing apparatus. These filaments may subsequently be laid down to form the composite nonwoven of the present invention and also be consolidated, and split into the elemental filaments, by hydrofluid treatment.

This provides the advantage that the production of spunbond nonwovens having different filament linear densities does not have to take place separately and no additional unification is needed to obtain a multicomponent spunbonded consisting of different filaments having different filament linear densities.

A preferred embodiment of the invention provides three or more, preferably 5 or more, rows of spinheads each having unitary spinneret die orifices to produce composite filaments of differing elemental filament count or a mixture of composite filaments with monocomponent filaments in one conjoint spinning and drawing apparatus. It is alternatively also possible for one or more than one row of correspondingly different spinneret die orifices to be present in one spinneret die pack (curtain spinning) or for a multiplicity of individual spinneret die packs to be present in one so-called traversing laydown.

These may subsequently be laid down to form a web and also be consolidated, and split into the elemental filaments, by hydrofluid treatment. Hydrofluid consolidation may be preceded by a mechanical or thermal method of preconsolidation. This embodiment provides composite nonwovens consisting of plies having a differing filament linear density, and thereby inherently combining textile physical properties that are otherwise only attainable by combining separately produced plies.

The method of the present invention is advantageously further developed such that the order of the spinning stations in relation to the laydown belt is chosen so as to make it possible to obtain the above-described layered structures in an arrangement ABA or $A(BA)_nBA$ of the composite plies. In a preferred embodiment of the invention, the order of the spinning stations in relation to the laydown belt is chosen so as to create an alternating linear density for the filaments across the thickness of the composite nonwoven.

As noted above, the composite filaments may for ease of separation into the elemental filaments have an opening in the middle, in particular in the form of a tubular elongate cavity which, in relation to the midpoint axis of the composite filaments, may be centered. This arrangement makes it possible to reduce/avoid the narrow contact between the elemental filaments formed by the inside angles of the wedges and/or circular cutouts before separation of the elemental filaments, and also the contact in this region of various elemental filaments made of the same polymeric material.

To further consolidate the composite nonwoven fabric, the composite filaments may have a latent or spontaneous crimp resulting from an asymmetrical construction of the elemental filaments in relation to the longitudinal midpoint axis thereof, and this crimp may optionally be activated or reinforced by an asymmetrical, geometrical design for the cross section of the composite filaments. This makes it possible to endow the nonwoven with high thickness, a low modulus and/or a multiaxial elasticity.

In one version, the composite filaments may have a latent or spontaneous crimp attributable to the physical properties of the polymeric materials forming the elemental filaments becoming differentiated in the composite filament spinning, cooling and/or stretching operations in a way that leads to twists caused by internal unsymmetrical stresses in relation to the longitudinal midpoint axis of the composite filaments, while said crimp is optionally activated or reinforced by an asymmetrical, geometric design for the cross section of the composite filaments. The composite filaments may have a latent crimp which is activated by a thermal, mechanical or chemical treatment before forming the composite nonwoven.

The crimp may be for example thermally or chemically reinforced by an additional treatment before consolidating the nonwoven. The web of the present invention is preferably consolidated by treatment with high pressure fluid jets. The elemental filaments may thus be substantially tangled—during or after partitioning the composite filaments—using a mechanical means (needling, liquid pressurized jets) acting overwhelmingly at right angles to the plane of the material.

The filaments, especially the composite filaments, may be laid down for example under mechanical and/or pneumatic deflection, in which case two or more of these deflection modes may be combined, and also by hurling onto an endless running track and mechanically by needling or by the action of liquid pressurized jets which may be charged with solid (micro)particles. The steps of tangling and dividing the composite filaments into elemental filaments may be effected in one and the same step and using one and the same apparatus, in which case the more or less complete separation of the elemental filaments can end with an additional operation more fully directed toward said separation.

The strength and mechanical robustness of the composite nonwoven may further be distinctly increased by providing that the elemental filaments become bonded to each other by thermofusion of one or more thereof preferably by hot calendering with heated, smooth or engraved rolls, by passage through a hot air tunnel oven, by passage over a hot air through drum and/or by application of a binder in powder form or from a dispersion or solution.

In one version, consolidation of the web may likewise be effected for example by hot calendering before any separation of the unitary composite filaments into elemental filaments, in which case the separation is effected after web consolidation.

The web fabric may further also be consolidated by a chemical treatment (as described for example in commonly assigned French patent document No. 2 546 536) or by a thermal treatment which leads to a controlled shrinkage of at least some of the elemental filaments, possibly after their separation. This results in the material shrinking widthways and/or lengthways.

The composite nonwoven may after consolidation be further subjected to a chemical type of binding or finishing operation, for example an antipilling treatment, a hydrophilicization or hydrophobicization, an antistatic treatment, a treatment to improve the fire resistance and/or to change the tactile properties or the luster, a mechanical type of treatment such as raising, sanforizing, sanding or a treatment in a tumbler and/or a treatment to change the appearance such as dyeing or printing.

Practical tests have shown that a composite nonwoven having a particularly homogeneous structure is obtainable when the web is preconsolidated by application of heat and/or pressure, preferably by calendering at a temperature of 160 to 220° C., preferably 180-200° C., and/or a line pressure of 20 to 80 N/mm.

The composite nonwoven of the present invention is advantageously further subjected to punctuate calendering to increase its abrasion resistance. To this end, the split and consolidated composite nonwoven is led through heated rolls whereof at least one roll has elevations that lead to punctuate interfusing of the filaments with each other. In a preferred embodiment of the invention, the composite filaments are dyed by spin dyeing.

On account of its good water pickup capacity (absorption capacity) in combination with its outstanding washfastness, the cleaning cloth of the present invention is outstandingly suitable for cleaning various surfaces. Particularly good results are obtained on cleaning smooth surfaces.

The present invention thus further provides the method of using the microfiber composite nonwoven of the present invention in the manufacture of contract linen. The advantage of the long durability of the nonwoven manifests itself particularly clearly in this use because it de facto leads to a prolongation of the reinvestment cycle. The long durability enables users to make use of textiles whose raw material consumption can be reduced owing to the very long use life. The nonwoven of the present invention thus also constitutes a product with improved sustainability.

The invention will now be more particularly described with reference to several examples.

Examples 1 to 12

Production of Various Nonwovens

PIE 8, 16, 32 plies having basis weights (BW) of about 22 g/m$^2$ and 43 g/m$^2$ are established in the following compositions:

TABLE 2

| No. | Target BW [g/m$^2$] | Ply Composition 8 = 8 pie 16 = 16 pie 32 = 32 pie |
|---|---|---|
| (01) | 130 | 16 |
| (02) | 130 | 8 |
| (03) | 130 | 32 |
| (04) | 130 | 16-8-32 |
| (05) | 130 | 32-8-16 |
| (06) | 130 | 32-8-32 |
| (07) | 130 | 32-8-8-8-32 |
| (08) | 130 | 32-16-16-16-32 |
| (09) | 130 | 32-16-8-16-32 |
| (10) | 130 | 8-32-32-32-8 |
| (11) | 1 × 43 (129) | 1 × 32 |
| (12) | 1 × 22 (110) | 1 × 32 |

Nonwovens 6, 7, 8 and 9 are composite nonwovens in accordance with the present invention and nonwovens 1, 2, 3, 4, 5, 10, 11 and 12 are reference nonwovens.

To produce the nonwovens, nonwoven plies are produced in a first step from PIE 16, PIE 8 and PIE 32 segmented bicomponent filaments.

The production of PIE 32 in a bicomponent spunbonding range will now be described by way of example.

The following raw materials are used:

| Granules | Proportional parts | |
|---|---|---|
| PES | PET INVISTA | 50 |
| Polyamide | PA6 BASF | 50 |
| Hydrophilic (PET) | CLARIANT | 0.05 in PET |
| TiO2 | CLARIANT Renol weiss | 0.05 in PET |
| Antistat (PA6) | CLARIANT Hostastat | 0.05 in PA6 |

Extruder:
PET, zones 1-7: 270-295° C.
PA6, zones 1-7: 260-275° C.
Spinning pumps:

| | | | |
|---|---|---|---|
| volume, rotary speed, throughput, PET: | 20 cm3/rev | 9.1 revs/min | 0.35 g/L/min |
| volume, rotary speed, throughput, PA6: | 6 cm3/rev | 34.7 revs/min | 0.35 g/L/min |
| overall throughput: | | | 0.7 g/L/min |

Dies: Type, PIE 32,

Pneumatic Drawing:

Laying; onto a laydown belt at a speed setting resulting in a web basis weight of 22 and/or 43 g/m$^2$.

Preconsolidation via calender, steel rolls smooth/smooth:

The structure of the PIE 32 segmented bicomponent filaments obtained is illustrated in FIG. 1.

To produce the composite webs, the plies are arranged on top of each other in the desired order. The individual plies are subsequently split and felted into a multifilament component nonwoven by water jet consolidation.

Since the same target weight (of about 130 g/m$^2$) is envisioned for all composite versions, a fixed experimental protocol is chosen for the water jet entanglement of all the versions irrespective of whether they are 5×22 g/m$^2$ or 3×43 g/m$^2$, PIE 8, 16 or 32.

Water jet conditions are set as follows:

| | Pressure (bar) | Aspiration (mbar) |
|---|---|---|
| Preconsolidation: | 0.4 | −728 |
| Die beam 2: | 2.8 | −74 |
| Die beam 3: | 230 | −206 |
| Die beam 4: | 0.1 | −206 |
| Die beam 5: | 230 | −871 |
| Die beams 3 and 5 are opposite each other. | | |
| Die strip hole diameter: 130 μm | | |
| Laydown belt: 100 mesh | | |
| Belt speed: 12 m/min | | |
| Repetition of passage: 2× (i.e., altogether 3 passages) | | |

Drying conditions are set as follows:

One drying operation is carried out in a through air dryer about 4 m in length at an air temperature of 190° C. and a belt speed of 12 m/min.

The water jet consolidation is accompanied by a nearly complete splitting of the bicomponent filaments into the respective elemental filaments. At the same time, the fine PIE 32 elemental filaments of the outer plies are transported deeply into the nonwoven and intertwine not only with each other but also with the thicker PIE 8 or PIE 16 elemental filaments (tentacle effect), which surprisingly leads to a particularly high durability on the part of composite nonwovens 6, 7, 8, 9 according to the invention. In addition, owing to the outer ply of very fine PIE 32 elemental filaments, the nonwovens of the invention exhibit outstanding performance characteristics, such as good thermophysiological comfort, pleasant skin sensorics and a pleasant appearance. Owing to the inner ply of thicker filaments, the composite nonwoven of the invention further offers outstanding water pickup capacity and tear strength.

Example 13

Testing the Nonwovens for Various Parameters

The tests are based on the following standards:

| | | |
|---|---|---|
| BW | basis weight (g/m$^2$) | EN 965 |
| | thickness (mm) | EN 964-1 |
| UTS | ultimate tensile strength (N/5 cm) | EN 13934-1 |
| | extension at UTS (%) | EN 13934-1 |
| | modulus (N) | EN 13934-1 |
| | porosity (μm) | ISO 2942/DIN 58355-2 |
| TS | tear strength (N) | EN 13937-2 |
| | abrasion (Martindale, 9 KPa | EN 12947 |
| | air permeability (1/m$^2$/s) | EN 9237 |
| | pilling (grade) | DIN 53867 (in line with) |
| | water pickup (%) | in line with DIN 53923 |
| | industrial wash (here at 75° C.) | in line with DIN EN ISO 155797 (cycles to hole) |

The results of the tests are presented in the tables which follow:

Textile physical assessment

TABLE 3

| No. | | | 1 | 2 | 3 | 4 | 5 | 6* | 7* | 8* | 9* | 10 | 11 | 12 |
|---|---|---|---|---|---|---|---|---|---|---|---|---|---|---|
| BW target | | (g/m$^2$) | 130 | 130 | 130 | 130 | 130 | 130 | 130 | 130 | 130 | 130 | | |
| Type of PIE | | | 16 | 8 | 32 | 16-8-32 | 32-8-16 | 32-8-32 | 32-8-8-8-32 | 32/16/16/16/32 | 32/16/8/16/32 | 8/32/32/32/8 | 32/32/32 | 32/32/32/32/32 |
| BW measured | | (g/m$^2$) | 151 | 149 | 128 | 136 | 142 | 139 | 118 | 119 | 119 | 129 | 39 | 27 |
| Thickness | | (mm) | 0.58 | 0.63 | 0.5 | 0.55 | 0.57 | 0.55 | 0.52 | 0.48 | 0.49 | 0.49 | 0.23 | 0.16 |
| Dynamométrie à 20° C. à 400 mm/mn | | | | | | | | | | | | | | |
| UTS | along | (N/5 cm) | 502 | 503 | 344 | 364 | 346 | 383 | 320 | 325 | 309 | 336 | 56 | 48.5 |
| | across | (N) | 303 | 335 | 217 | 249 | 244 | 178 | 277 | 264 | 290 | 171 | 62 | 19 |
| Isotropy | | | 1.66 | 1.50 | 1.59 | 1.46 | 1.42 | 2.15 | 1.81 | 1.98 | 1.63 | 1.96 | 0.90 | 2.55 |
| Stretch breakage | along | (%) | 65 | 65.5 | 58 | 55 | 48 | 60 | 53 | 53 | 54.5 | 56 | 27 | 29 |
| | across | (%) | 89.5 | 93 | 78.5 | 85 | 83.5 | 73 | 69.5 | 71 | 77 | 77 | 54 | 56.5 |
| Modulus 3% | along | (N) | 98 | 75 | 88 | 77 | 74 | 87 | 74 | 73 | 74 | 73 | 18 | 16 |
| | across | (N) | 18 | 12 | 20 | 14 | 13 | 13 | 14 | 12 | 14 | 11 | 6 | 0.8 |
| Modulus 5% | along | (N) | 128 | 104 | 108 | 101 | 99 | 110 | 94 | 95 | 92 | 96 | 24 | 21 |
| | across | (N) | 26 | 19 | 28 | 20 | 19 | 18 | 20 | 17 | 20 | 15 | 8.2 | 1.1 |
| Modulus 15% | along | (N) | 291 | 193 | 165 | 169 | 171 | 176 | 154 | 156 | 148 | 158 | 41 | 35 |
| | across | (N) | 57 | 52 | 56 | 46 | 44 | 41 | 43 | 37 | 41 | 35 | 18 | 2.9 |
| Modulus 40% | along | (N) | 376 | 366 | 280 | 301 | 311 | 303 | 271 | 274 | 257 | 275 | — | — |
| | across | (N) | 135 | 144 | 118 | 114 | 114 | 97 | 102 | 89 | 97 | 85 | 46 | 12 |
| Average porosity | | (μm) | — | — | 6.4/6.7 | — | — | — | — | — | — | — | — | — |
| Maximum pore | | (μm) | — | — | 16.9/15.1 | — | — | — | — | — | — | — | — | — |
| TS before washing | SL | (N) | 14.9 | 12.7 | 5.2 | 7.9 | 8.5 | 13.0 | 11.9 | 7.1 | 7.9 | 6.8 | 2.4 | NA |
| | ST | (N) | 13.6 | 18.4 | 9.2 | 13.5 | 13.7 | 15.1 | 14.1 | 11.6 | 11.8 | 12.9 | 3.6 | NA |

TABLE 3-continued

| No. | | | 1 | 2 | 3 | 4 | 5 | 6* | 7* | 8* | 9* | 10 | 11 | 12 |
|---|---|---|---|---|---|---|---|---|---|---|---|---|---|---|
| Martindale 9 KPa | | holing | 12 000 | 18 000 | 60 000 | 10 000 | 20 000 | 40 000 | 30 000 | 55 000 | 35 000 | 20 000 | 700 | 500 |
| Delamination | | (N/5 cm) | NA | NA | N/A | 26.3 | 27.9 | NA | NA | NA | NA | NA | NA | NA |
| Air permeability | 100 Pa | (l/m²/s) | — | — | 31.9 | — | — | — | — | — | — | — | — | — |
| Pilling | | face side | 4.5 | 1 | 4.5 | 4 | 3.5 | 4.5 | 4 | 4.5 | 5 | 3 | 4.5 | 5 |
| Boil wash (95° C.) | | | | | | | | | | | | | | |
| | | | 1 | 2 | 3 | 4 | 5 | 6 | 7 | 8 | 9 | 10 | 11 | 12 |
| Wash shrinkage | along | (%) | −2.2 | −1.7 | −2 | −2.3 | −2.2 | −3 | −1.2 | −1.8 | −1.6 | −2.5 | −2.8 | −3 |
| | across | (%) | −0.8 | −0.8 | −0.3 | −0.5 | −0.2 | −0.2 | −0.8 | −0.4 | −0.4 | −0.5 | −1.5 | 0.4 |
| TS after washing | along | (N) | 13.6 | 18.5 | 5.6 | 6.8 | 6.5 | 6.5 | 5.8 | 3.9 | 4.8 | 7.2 | 2.4 | NA |
| | across | (N) | 16 | 19.4 | 9.5 | 10.4 | 11.9 | 11.7 | 10 | 7.5 | 11.5 | 12 | 4.1 | NA |

Analyzing the results in Table 3, it is first observed that all the subjects consisting of PIE 32 as a whole or on the outside score particularly high washfastnesses. This is surprising, as the fine filaments could not be expected to exhibit good mechanical strength. The cloths consisting wholly of PIE 32, however, have only limited utility, since inter alia their tear strengths are much too low. By contrast, the composite nonwovens of the invention are notable not only for satisfactory tear and ultimate tensile strengths but also for good washfastnesses. The table further reveals that surprisingly the abrasion resistance of the reference specimens increases disproportionately with decreasing linear density.

Example 14

Testing the Nonwovens for Cleaning Properties

The nonwovens were tested for water pickup and water release. They were also subjected to the crayon test.

Cleaning properties, water regimentation

| Property | Unit | No. 1 | No. 2 | No. 3 | No. 4 | No. 5 | No. 6 | No. 7 | No. 8 | No. 9 | No. 10 |
|---|---|---|---|---|---|---|---|---|---|---|---|
| Water pickup | wt % | 451 | 360 | 337 | 350 | 359 | 342 | 372 | 358 | 364 | 367 |
| Water release 1× wringing | wt % | 71 | 87 | 62 | 73 | 100 | 67 | 71 | 63 | 76 | 65 |
| Crayon test | wipe cycles | 22 | 25 | 25 | 29 | 23 | 27 | 32 | 30 | 34 | 17 |

Example 15

Testing the Nonwovens for Sustained Washing Results

The test specimens were machine washed in succession, interrupted after every 50 washes for evaluation, and washed until visible holing. Washing was then discontinued:

| Specimen | Cycles to holing |
|---|---|
| No. 1 | 400 |
| No. 2 | 250 |
| No. 3 | 800 |

-continued

| Specimen | Cycles to holing |
|---|---|
| No. 4 | 400 |
| No. 5 | 450 |
| No. 6 | 500 |
| No. 7 | 500 |
| No. 8 | 600 |
| No. 9 | 550 |
| No. 10 | 350 |

Example 16

Visual Inspection of Nonwovens

FIGS. 2 to 6 show photographs of surfaces of exemplary nonwovens.

Figure 2:
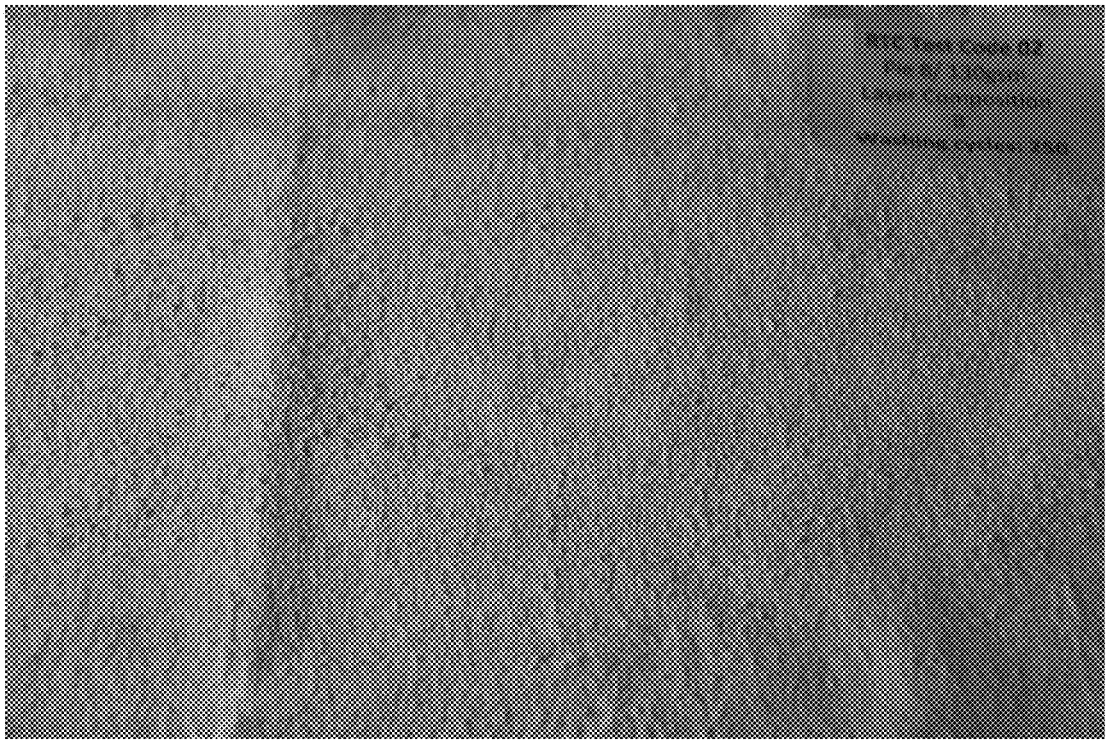
FIG. 2 shows a surface texture of comparative nonwoven No. 2, after 250 wash cycles.

FIG. 2 depicts the surface texture of nonwoven No. 2, which is not in accordance with the present invention, after 250 wash cycles. It transpires that the surface is very rough and has a high pilling grade.

Figure 3:
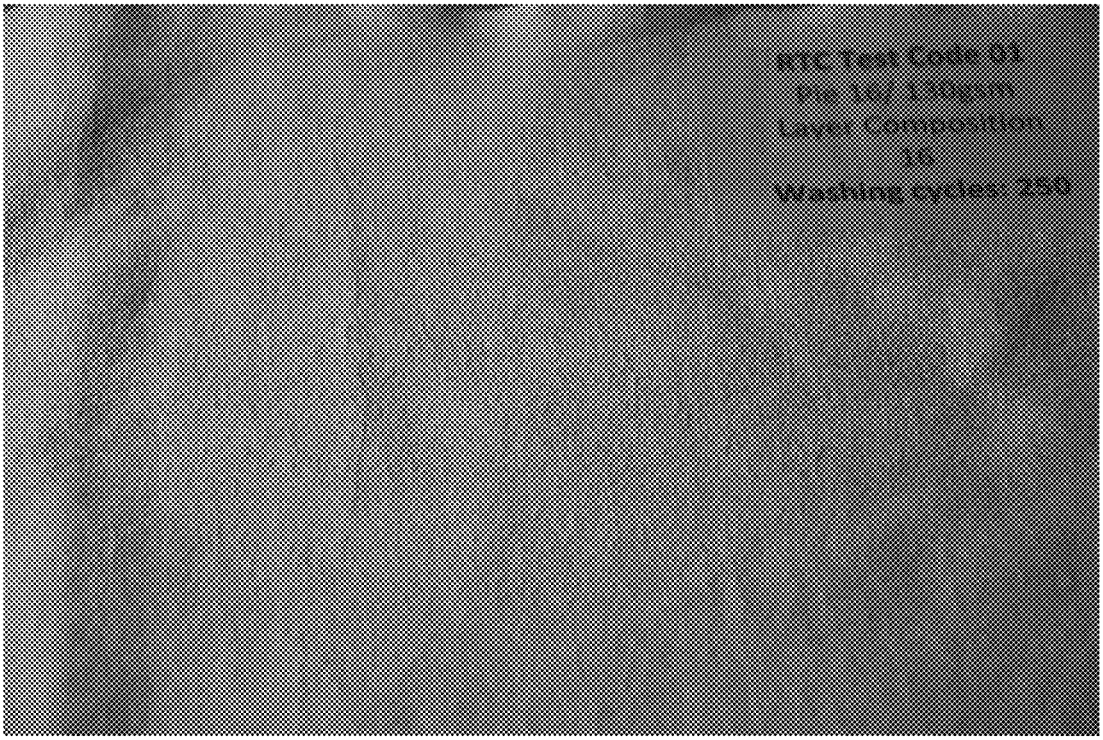
FIG. 3 shows a surface texture of comparative nonwoven No. 1, after 250 wash cycles.

FIG. 3 depicts the surface texture of nonwoven No. 1, which is not in accordance with the present invention, after 250 wash cycles. While the surface has an improved appearance compared with nonwoven No. 2, it is still rough and has a high pilling grade.

Figure 4:
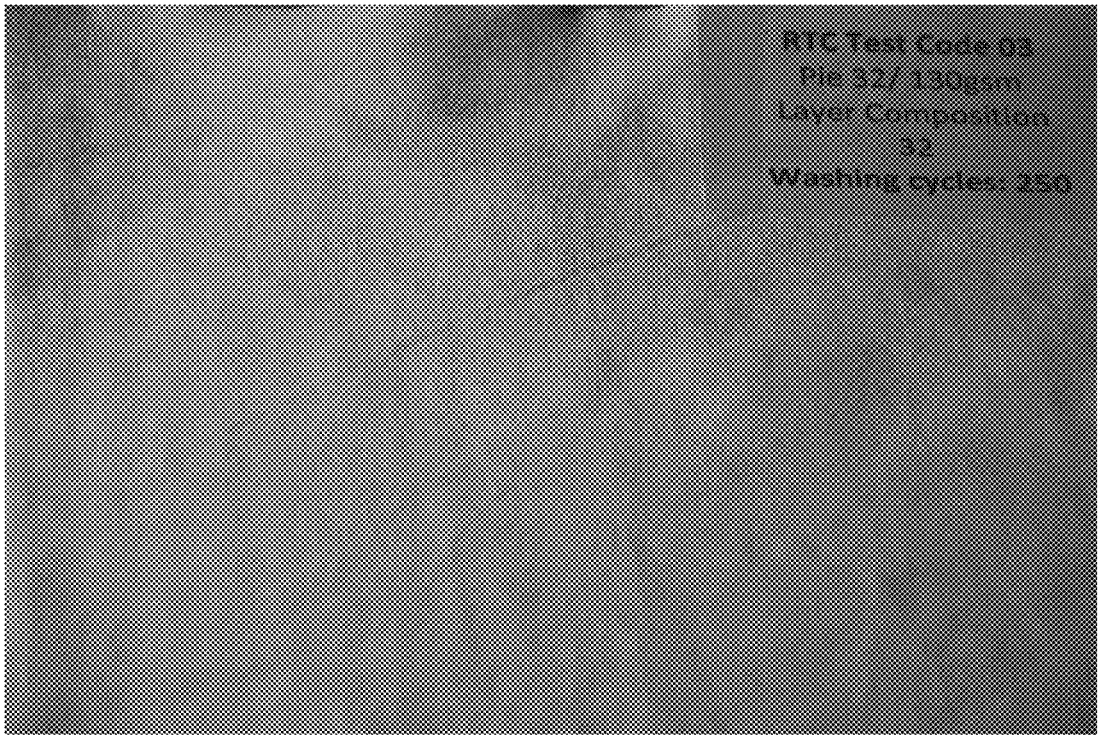
FIG. 4 shows a surface texture of comparative nonwoven No. 3, after 250 wash cycles.

FIG. 4 depicts the surface texture of nonwoven No. 3, which is not in accordance with the present invention, after 250 wash cycles. The surface has a significantly improved appearance compared with nonwoven No. 2. As already mentioned above, however, the nonwoven consisting wholly of PIE 32 has only limited utility, since inter alia its tear resistance is much too low.

Figure 5:
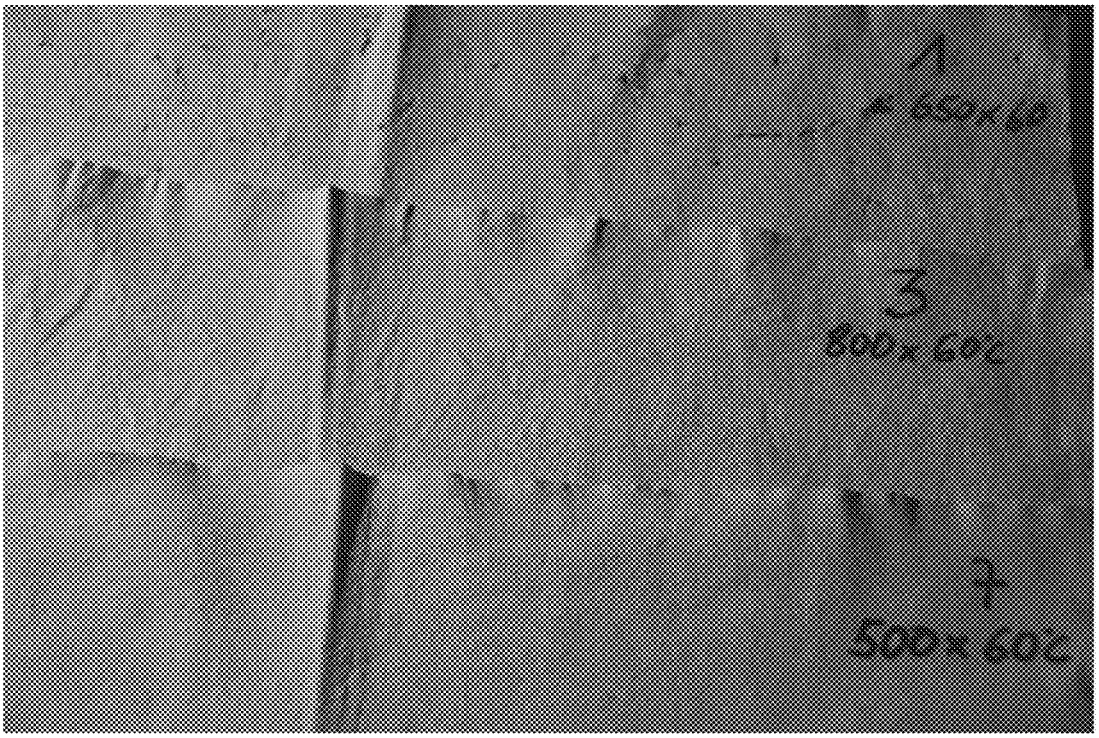
FIG. 5 shows surface textures of inventive nonwoven No. 7 (after 500 washing cycles) versus comparative nonwovens 1 (after 650 washing cycles) and 3 (after 800 washing cycles)

In FIG. 5, the surface textures of inventive nonwoven No. 7 after 500 washing cycles are compared with the non-inventive nonwovens 1 (after 650 washing cycles) and 3

(after 800 washing cycles). It transpires that the surface of inventive nonwoven No. 7 has a similar appearance to nonwoven No. 3, which consists of PIE 32 only. In addition, it is notable for outstanding performance characteristics, for example good water management, a high tear strength, a good pilling grade and good cleaning properties. In contrast, non-inventive nonwoven 1 displays pronounced holing.

Figure 6:
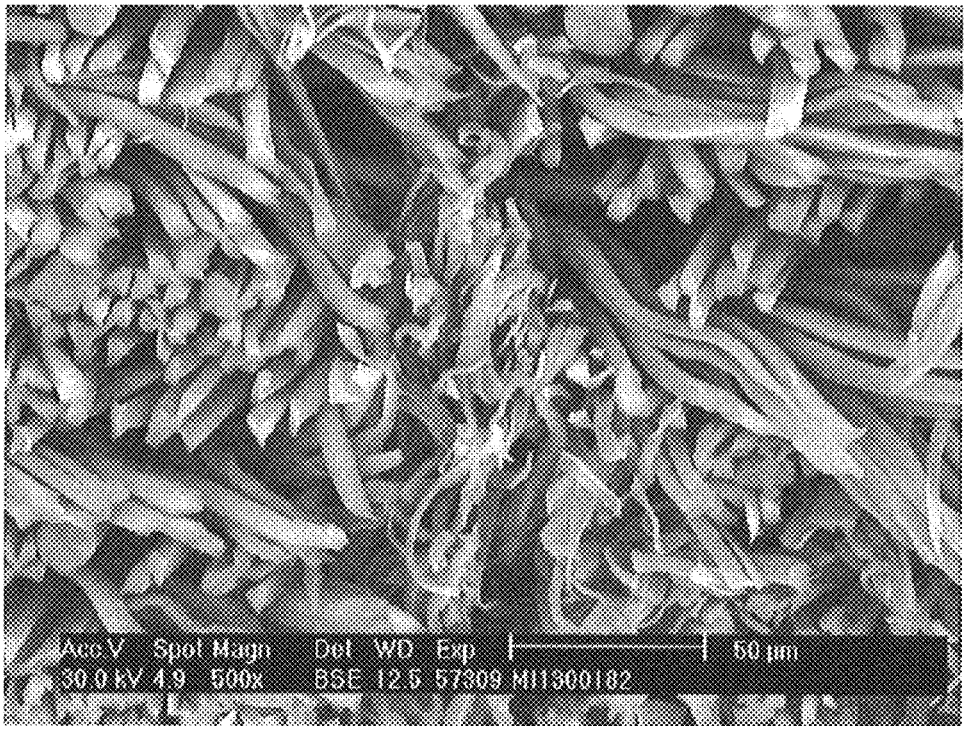
FIG. 6 shows a cross section through inventive nonwoven No. 7.

FIG. 6 depicts a cross section through inventive nonwoven No. 7. The so-called "tentacle effect" is distinctly visible in that the fine PIE 32 elements have been carried, by the water jet consolidation, deep into the plies of coarser filaments.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A cleaning cloth, comprising:

a microfiber composite nonwoven comprising a first fibrous component and a second fibrous component, arranged as alternating plies, wherein at least one first ply A comprises the first fibrous component as melt-spun composite filaments laid down to form a web, at least some of which have been split into elemental filaments having an average linear density of less than 0.1 dtex, and consolidated, wherein at least one ply B is arranged on the first ply A, wherein the ply B comprises the second fibrous component as fibers having an average linear density of 0.1 to 3 dtex which have been laid down to form a web and consolidated, wherein at least one second ply A is arranged on the ply B, wherein the filaments of the first fibrous component are at least partially intertwined with the fibers of the second fibrous component due to the microfiber composite nonwoven receiving a treatment with high pressure water jets, a pressure of the high pressure water jets being of a level such that the cleaning cloth is free of holes after 450 industrial washing cycles according to DIN EN 155797, the treatment with high pressure water jets taking place at least once on each side of the at least one ply B.

2. The cloth of claim 1, having a layered construction $A(BA)_nBA$, wherein n is in a range of from 1 to 20.

3. The cloth of claim 1, wherein composite filaments of the first and/or second fibrous components have a cross section of orange-type or pie multisegmented structure.

4. The cloth of claim 1, wherein fibers of the first fibrous component have a pie arrangement including 24, 32, 48, or 64 segments.

5. The cloth of claim 3, wherein the composite filaments comprise different filaments comprising two or more incompatible thermoplastic polymers.

6. The cloth of claim 1, wherein the second fibrous component comprises composite filaments including 2, 4, 8, 16 elemental filaments.

7. The cloth of claim 1, wherein a ratio of the average filament linear density of the filaments of the second to the first fibrous component is a range of from 10 to 30.

8. The cloth of claim 1, comprising the filaments of the first fibrous component in an amount of from 20-60 wt %, based on an overall weight of the nonwoven.

9. The cloth of claim 1, comprising the filaments of the second fibrous component in an amount of from 40-80 wt %, based on an overall weight of the nonwoven.

10. The cloth of claim 1, wherein the microfiber composite nonwoven includes a surface formed by the elemental filaments of the first fibrous component.

11. The cloth of claim 1, having a ply sequence $A(BA)_nBA$, wherein n is in a range of from 1 to 15, wherein the plies A comprise at least partially split pie 32 filaments, wherein the plies B comprise at least partially split pie 8 filaments, wherein a linear density of the elemental filaments of the pie 32 filaments is less than 0.1 dtex, and wherein a linear density of the elemental filaments of the pie 8 filaments is 0.1 to 3 dtex.

12. The cloth of claim 1, further comprising, between the plies A and B:

a further ply.

13. The cloth of claim 1, having a symmetrical layered construction.

14. The cloth of claim 1, wherein the elemental filaments of the first fibrous component have an average linear density in a range of from 0.03 to 0.06 dtex.

15. The cloth of claim 1, wherein the second fibrous component comprises composite filaments consisting essentially of 2, 4, 8, 16 elemental filaments.

16. The cloth of claim 1, wherein the second fibrous component comprises composite filaments consisting essentially of 8 elemental filaments.

17. The cloth of claim 1, comprising the filaments of the second fibrous component in an amount of from 50 to 70 wt %, based on an overall weight of the nonwoven.

18. The cloth of claim 1, further comprising, between the plies A and B:

a reinforcing ply.

19. A method of forming the cloth of claim 1, the method comprising:

separately spinning two or more fiberplies A comprising filaments of the first fibrous component and one or more than one fiberply B comprising filaments of the second fibrous component, laid down to form a web and optionally, by needling for example, preconsolidated;

alternately arranging the fiberplies A and B arranged on top of each other, subject to the proviso that the outer plies are the fiberplies A; then hydrofluidically treating the ply assembly to split the first and, optionally, also the second fibrous component, and to consolidate the plies A and B both within and between; and finishing the ply assembly to form the cleaning cloth.

20. A method of cleaning, comprising:

contacting the cleaning cloth of claim 1 to a smooth surface.

* * * * *